US007077587B2

(12) United States Patent
Tanaka

(10) Patent No.: US 7,077,587 B2
(45) Date of Patent: Jul. 18, 2006

(54) TAPE PRINTING APPARATUS WITH TAPE CASSETTE GUIDE MEMBERS

(75) Inventor: Mitsugi Tanaka, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/790,795

(22) Filed: Mar. 3, 2004

(65) Prior Publication Data

US 2004/0190971 A1 Sep. 30, 2004

(30) Foreign Application Priority Data

Mar. 28, 2003 (JP) ..... 2003-090525

(51) Int. Cl.
*B41J 33/00* (2006.01)

(52) U.S. Cl. ..... 400/247; 400/120.01; 400/250; 400/621

(58) Field of Classification Search ..... 400/247, 400/250, 242, 621, 120.01
See application file for complete search history.

(56) References Cited

U.S. PATENT DOCUMENTS 4,624,592 A * 11/1986 Purcell ..... 400/208
4,917,514 A * 4/1990 Richardson et al. ..... 400/208
5,188,469 A 2/1993 Nagao et al.
5,306,097 A * 4/1994 Kaneko ..... 400/694
5,324,123 A * 6/1994 Hattori ..... 400/207
5,383,733 A * 1/1995 Zinsmeyer et al. ..... 400/208
5,419,643 A * 5/1995 Matsuura ..... 400/208
5,433,540 A * 7/1995 Alday ..... 400/250
5,494,362 A * 2/1996 Kobayashi et al. ..... 400/208
5,500,669 A * 3/1996 Yamashita et al. ..... 347/214
5,653,542 A * 8/1997 Sugimoto et al. ..... 400/248
5,997,194 A * 12/1999 Nunokawa et al. .... 400/120.01
6,030,135 A * 2/2000 Imai ..... 400/621
6,106,170 A * 8/2000 Watanabe et al. ..... 400/61
6,367,995 B1 * 4/2002 Hashimoto et al. ..... 400/207
6,371,670 B1 * 4/2002 Kojo ..... 400/120.01
6,644,873 B1 * 11/2003 Kurashina ..... 400/61

FOREIGN PATENT DOCUMENTS

EP 0 816 104 A2 1/1998
EP 1 288 006 A2 3/2003
JP A 8-25753 1/1996

* cited by examiner

*Primary Examiner*—Andrew H. Hirshfeld
*Assistant Examiner*—Dave A. Ghatt
(74) *Attorney, Agent, or Firm*—Oliff & Berridge, PLC

(57) ABSTRACT

A tape printing apparatus uses a tape cassette having two guide holes, the tape printing apparatus has a tape cassette holder including at least first and second guide members; the first guide member having a height that is shorter than a height of the second guide member; such that the second guide member is inserted into a second guide hole on the tape cassette before the first guide member is inserted into a first guide hole of the tape cassette.

41 Claims, 16 Drawing Sheets

TAPE PRINTING APPARATUS WITH TAPE CASSETTE GUIDE MEMBERS

BACKGROUND OF THE INVENTION

1. Field of Invention

This invention relates to a tape printing apparatus using a thermal head for printing characters or other images on a tape. This invention particularly relates to a tape printing apparatus that allows any user to install the tape cassette easily and without tape jam.

2. Description of Related Art

Various related art tape printers have been proposed which use a thermal head to print characters and the like on a tape stored in a tape cassette and installed in a tape cassette holder. See, e.g., Japanese Patent Application Laid-Open No. HEI8-025753.

These compact tape printing apparatus generally use tape cassettes which store tape and ink ribbon. The tape cassette is attached to the tape cassette holder on the tape printing apparatus. The thermal head is provided on a thermal head holding member. The thermal head holding member projects into the tape cassette holder. The tape and ribbon for printing are stored in the tape cassette.

The thermal head holding member may be board-shaped and may be made from any material having suitable mechanical properties, such as, for example, iron. The thermal head holding member is higher than the wall around the tape cassette holder, and its top comes out higher than the surrounding wall of the tape cassette holder.

At the beginning of installation of the tape cassette into the tape cassette holder, the thermal head holding member is initially made to go through a first guide hole of the tape cassette. The first guide hole is surrounded by naked tape (i.e., tape that has been unwound from a spool in the tape cassette) and an arm-shaped part of the tape cassette through which the tape passes.

After that, the tape cassette is brought to its correct position and is held in place by a wall of the tape cassette holder.

Recently, the tape printing apparatus have been designed to be more compact in size. To make the tape printing apparatus more compact, many parts need to be arranged in a very small space. Therefore, various parts are arranged in the space surrounding the thermal print head holding member. For example, a Flexible Flat Cable, hereafter FFC may be used to connect the thermal head and a tape printing control circuit board around the thermal head holding member.

As noted above, when a tape cassette is installed into the tape cassette holder, initially the thermal head holding member is inserted into the first guide hole of the tape cassette. Therefore, when the tape is drawn out from a release part of the tape cassette, there is a danger of the tape catching in the parts arranged around the thermal head holding member. Sometimes, the naked part of the tape is caught in the FFT or another part arranged around the thermal head holding member causing the tape to jam. When the tape is caught on something around the thermal head, tape jam occurs and the tape cassette will be unusable even if there is tape or ribbon left in the tape cassette. This is bad for the environment and not economical.

SUMMARY OF THE INVENTION

This invention is made to reduce or prevent the tape jam problems mentioned above.

One object of the invention is to provide a tape printing apparatus in which any user can easily install a tape cassette without tape jam, even if there are many parts arranged around the thermal head holding member to make the tape printing apparatus more compact.

The tape printing apparatus according to an aspect of the invention includes a tape cassette holder which holds a tape cassette which has two guide holes and tape, a first guide member provided vertically, and a second guide member provided vertically. According to one embodiment, a thermal head chip is fixed to the first guide member, and the second guide member is located close to a tape exit of the tape cassette holder.

When a user inserts the tape cassette into the tape cassette holder, the second guide member, which is higher than the first guide member, is inserted into the second guide hole on the tape cassette before the first guide member is inserted into the first guide hole. Subsequently, the first guide member, which is shorter than the second guide member, is inserted into the first guide hole on the tape cassette, and the tape cassette is tightly fixed in the tape cassette holder.

The tape printing apparatus according to an aspect of the invention includes a first guide member on which the thermal head and other parts are fixed, and a second guide member that is taller than the first guide member.

The tape printing apparatus according to some embodiments of the invention can reduce or prevent the occurrence of tape jams even if there are many parts arranged around the first guide member, because when the first guide member is inserted into the first guide hole, the posture of the tape cassette has already been fixed by the insertion of the second guide member into the second guide hole of the tape cassette. Therefore, any user can easily install a tape cassette without tape jam.

In another aspect of the invention, there can be three or more guide members that help to lead the tape cassette to its correct position while installing the tape cassette.

BRIEF DESCRIPTION OF THE DRAWINGS

Objects, features and advantages of the invention will become more apparent from reading the following description of exemplary embodiments taken in connection with the accompanying drawings in which:

FIGS. 7A to 7C are explanatory schematic views of a thermal head chip in which: FIG. 7A is a plan view of the thermal head chip; FIG. 7B is a perspective view of the thermal head chip soldered to an FFC; and FIG. 7C is a perspective view of a mounting plate for the thermal head chip;

DETAILED DESCRIPTION OF EXEMPLARY EMBODIMENTS

Figure 1:
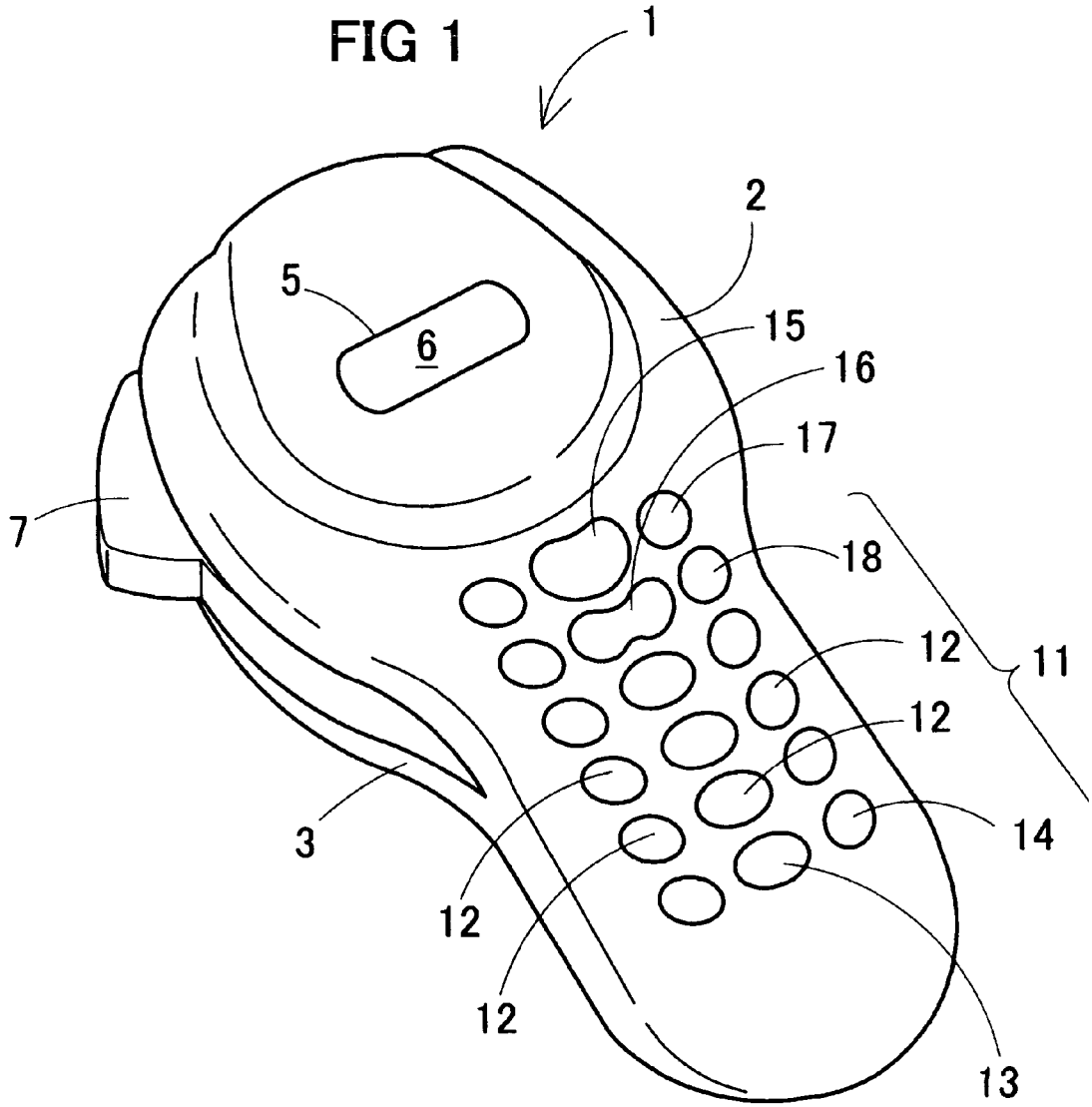
FIG. 1 is a perspective view of a tape printing apparatus according to one exemplary embodiment of the invention.
Figure 2:
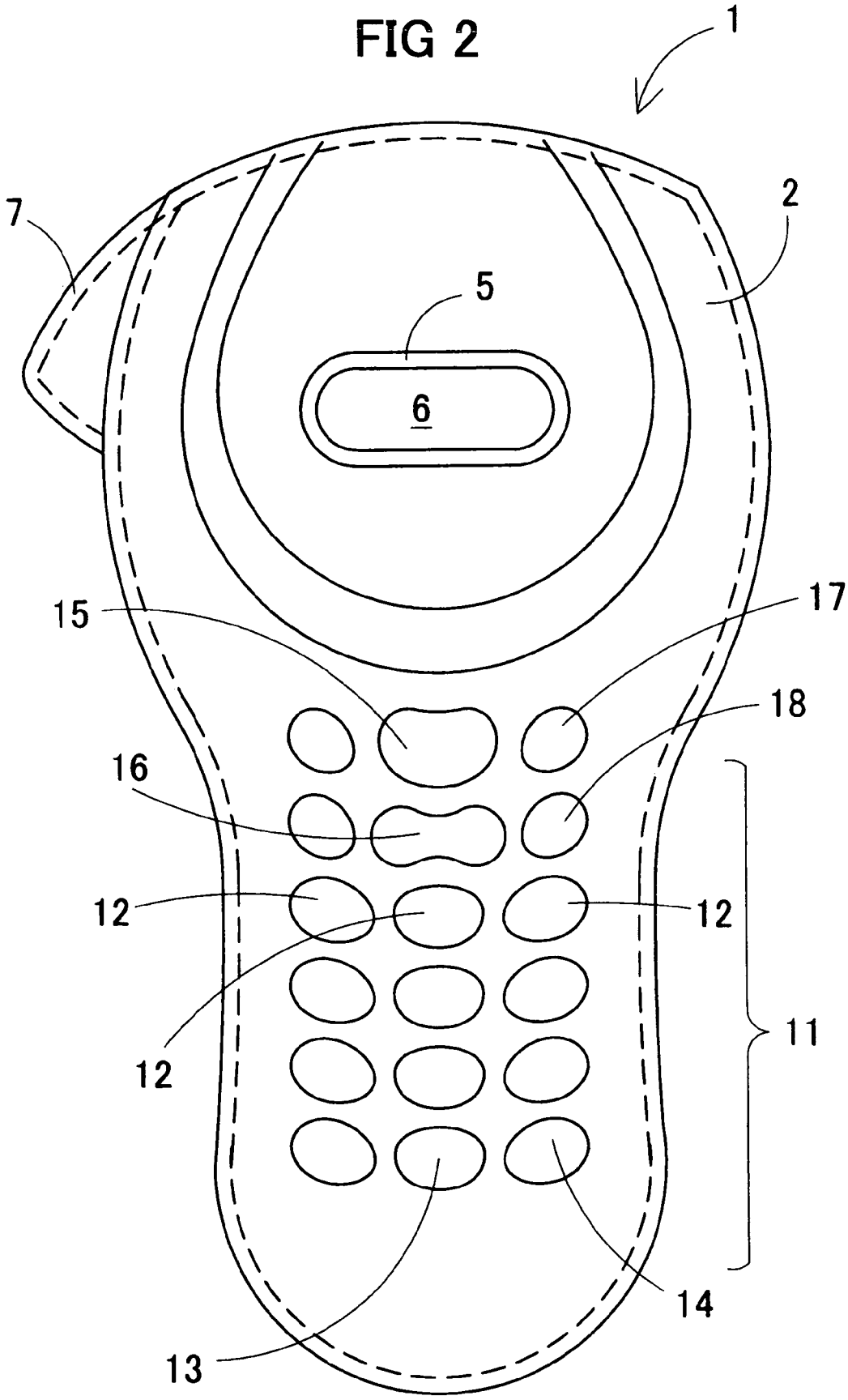
FIG. 2 is a plan view of the tape printing apparatus.
Figure 3:
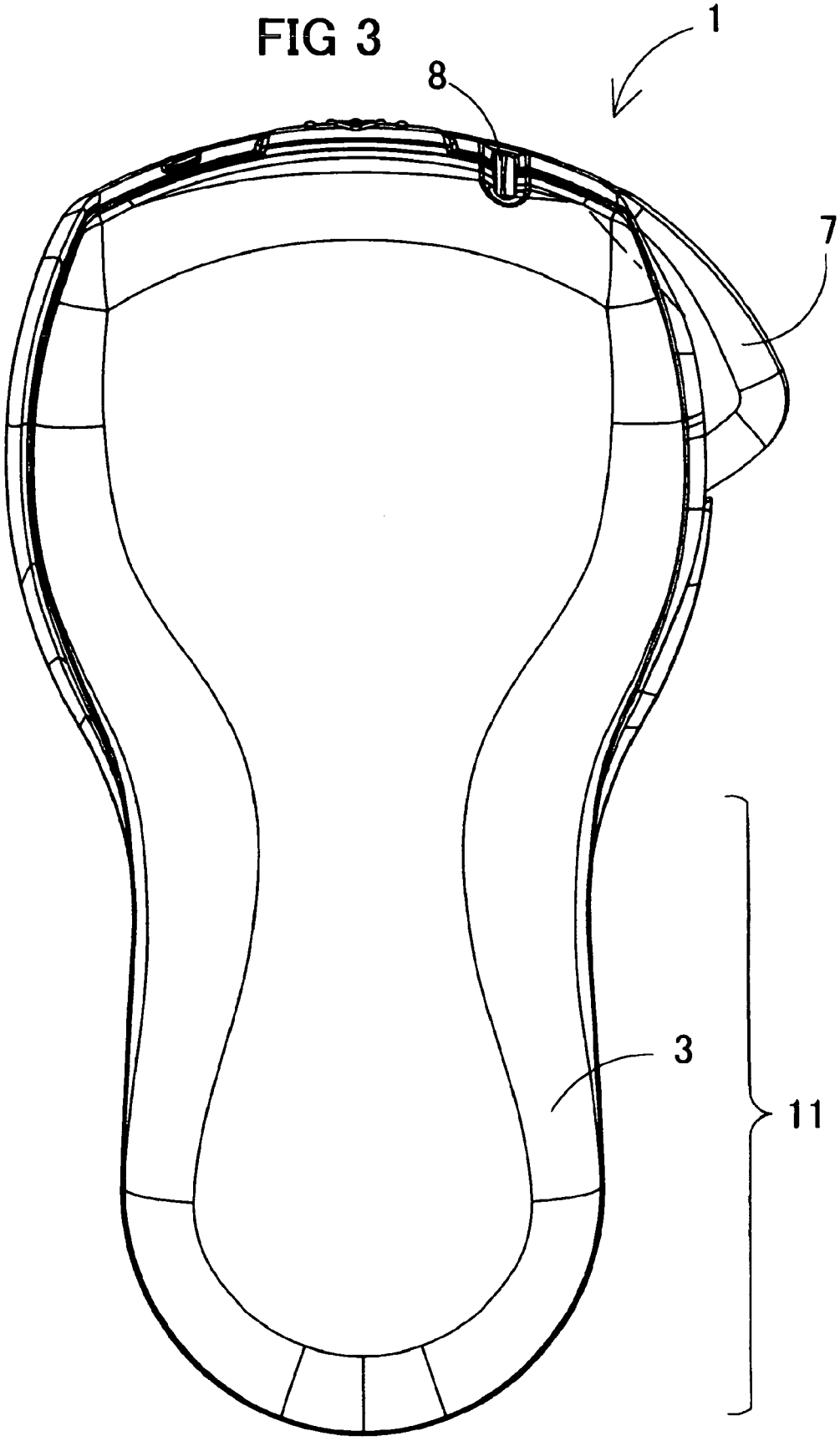
FIG. 3 is a bottom view of the tape printing apparatus.

Exemplary embodiments of the invention will be described below in detail with reference to the accompanying drawings.

A first exemplary embodiment of the invention will be described by reference to FIG. 1 through FIG. 4.

As shown in FIG. 1 through FIG. 4, the tape printing apparatus 1 includes a body 2 (in this example, made from plastic), and a detachable rear cover 3 (in this example, made from plastic) which covers the whole rear side of the body 2, the opposite side of the side facing a user when the user uses the tape printing apparatus. The upper part of the body 2 in a longitudinal direction may be formed in a substantially rounded shape. The body 2 has an oblong window 5 provided substantially in the center of the surface of the upper part. A display 6 is arranged under this window 5. The display may be any suitable display, such as, e.g., an LCD (liquid crystal display).

A cut lever 7 is provided in the left side part of the display 6. A tape (not shown) made of thermal paper is fed out from a tape exit 8 (refer to FIG. 3 and FIG. 5), and can be cut by a cutter blade 9 (see FIGS. 8C and 9) moved by pushing cut lever 7. The tape is composed of a layer that receives images, and a strippable paper carrier which protects an adhesive that is provided on the back of the printing side of the thermal paper. The structure of the cutter mechanism that moves a cutter blade through the cut lever 7 and cuts the tape is well-known. Therefore, explanation of the structure of the cutter mechanism will be omitted. The tape is bitten between the cutter blade 9 and an anvil in order to be cut. The anvil can be provided as an independent part fixed on the guide member 39 (see part 19' in FIG. 9), or be molded as a part of the tape cassette 26 (see part 19 in FIG. 8C).

The lower half of the body 2 in the longitudinal direction may be formed a little narrower than the upper half to form a grip 11. The grip 11 has two side corners that are formed to be rounded. The rear cover 3 fixed on the body 2 is formed so that the whole thickness of the tape printing apparatus 1 becomes gently smaller from the area which confronts a tape cassette 26 in the longitudinal direction of grip 11. The thickness of the grip 11 is formed to gradually decrease from an upper portion to a lower portion in the longitudinal direction. These shapes are designed to make user gripping of the tape printing apparatus easy. There is a keyboard molded out of rubber or other suitable (preferably elastic) material on the surface of the grip 11.

The keyboard includes character input keys 12 to input character data, a space key 13 to input a blank space, a changeover key 14 to change between a capital letter and a small letter, a printing key 15 to start printing labels, a cursor key 16 which moves a cursor right or left in the display 6 which displays characters or images, a power on/off key 17 that turns power supply on/off, and a return key 18 which directs a character choice or any other direction. Additional keys may be provided in various exemplary embodiments of the invention.

Each character input key 12 may function to input more than one character. A character for input is cyclically changed every time when the input key 12 is pushed. For example, every time the key 12 with legend "a", "b", "c" and "2" is pushed, there cyclically appears one of "a", "b", "c" and "2" at the position of the cursor in the display 6 one after another and the previous character is overwritten. Further, every time the changeover key 14 is pushed, the indicated character is cyclically replaced by its upper case and lower case. For example, "a" and "A", "b" and "B", or "c" and "C" are cyclically replaced by pushing the changeover key 14. The indicated character is confirmed as the character for input by pushing the return key 18.

Figure 4:
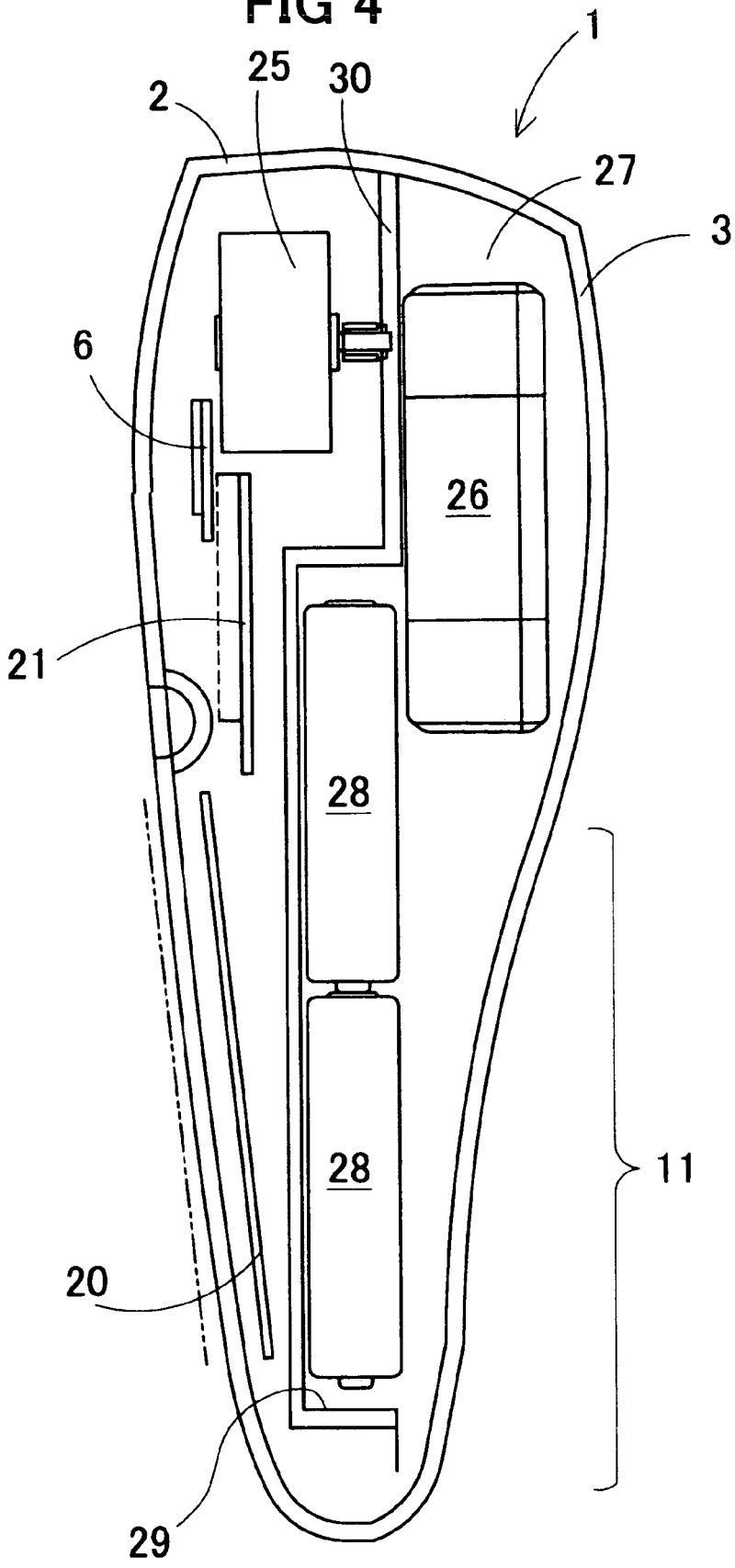
FIG. 4 is a sectional side view of the tape printing apparatus.

The key circuit board 20, on which the keyboard is arranged, is arranged in the back part of the grip 11 of the body 2 as shown in FIG. 4. A control circuit board 21, which controls the tape printing apparatus, is installed between the grip 11 and the display 6. There is a thermal head chip 32 in the upper half of the longitudinal direction of the body 2 (refer to FIG. 5). On the thermal head chip 32, there is a thermal head 50 driven by the control circuit board 21 (refer to FIG. 7). On a side of the tape which is opposite of the thermal head chip 32, there is a platen roller 23 that is driven by a motor 25 through gear train (not shown).

Figure 5:
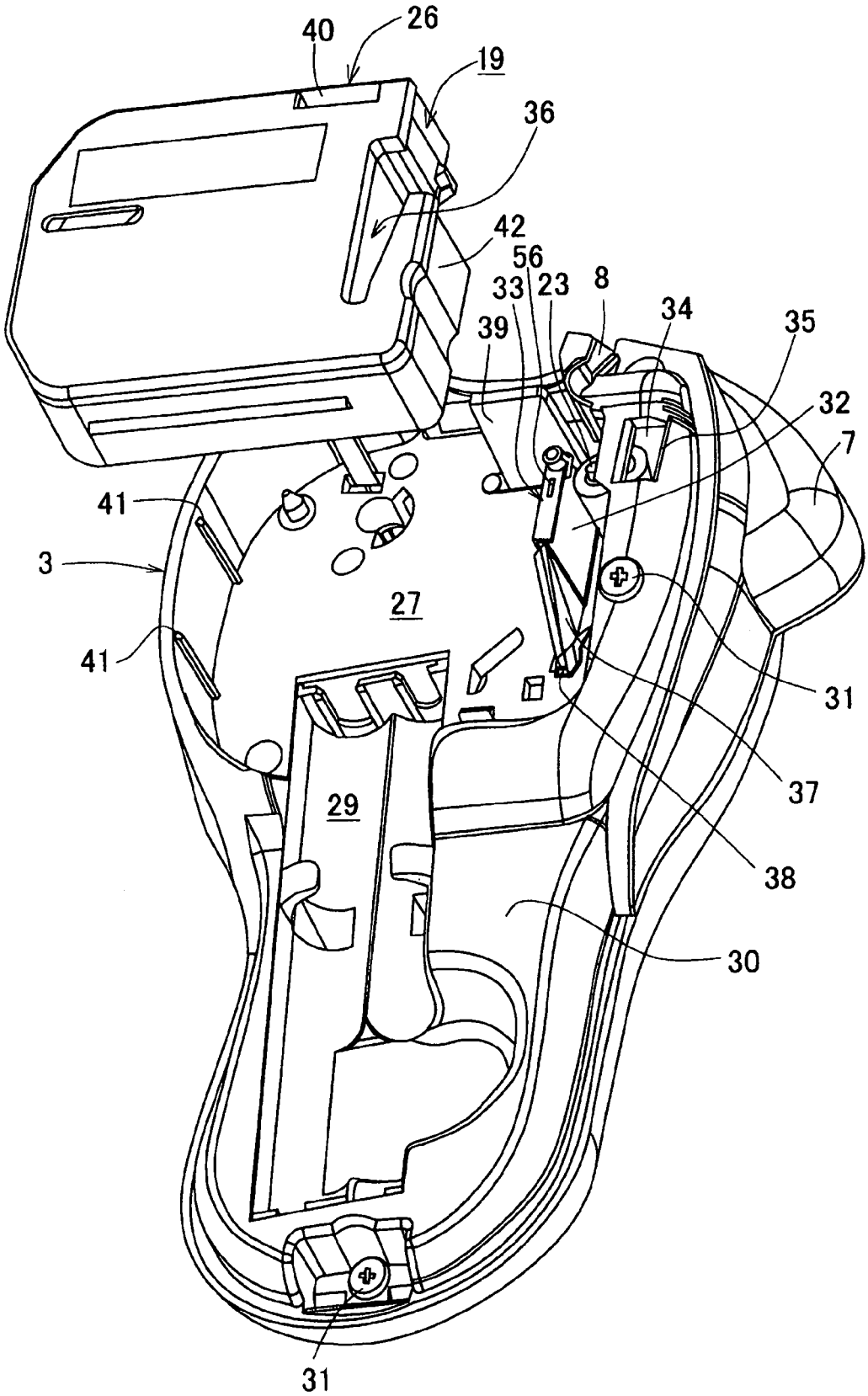
FIG. 5 is a perspective view of the tape printing apparatus without its rear cover.

A partition member 30 (preferably made of plastic) is fixed by screws 31 in the opening on the rear side of the body 2 as shown in FIG. 5. A tape cassette holder 27, in which a tape cassette 26 is stored, and a battery holder 29, which holds 4 dry cells 28, are formed in a rear part of the partition member 30 (refer to FIG. 5).

The interior of the body 2 will be described with reference to the FIG. 5. FIG. 5 shows the tape printing apparatus without the rear cover 3.

In particular, FIG. 5 shows tape cassette holder 27 and partition member 30. The tape cassette holder 27 is located in the upper half of the body 2 in the longitudinal direction, above the partition member 30. A horizontal section of the tape cassette holder 27 may be substantially rectangle-shaped and has almost the same contours as the tape cassette 26.

The depth of the tape cassette holder 27 is about equal to the thickness of the tape cassette 26. The tape cassette holder 27 is formed to swell behind the partition member 30, i.e., the holder 27 has a thickness such that it extends below (above in FIG. 5) the partition member 30.

The thermal head mounting plate 33 is provided vertically in the tape cassette holder 27 near the cut lever 7. That is, mounting plate 33 extends vertically (in the thickness direction) of the apparatus 1. The thermal head mounting plate 33 also extends along the longitudinal (top to bottom) direction of the body 2. The thermal head chip 32 on which the thermal head 50 is formed is fixed on the thermal head mounting plate 33. A hole is provided in the tape cassette holder 27, which faces the thermal head chip 32. A platen holder (not shown) that holds the platen is installed near the part of the partition member 30 which faces this hole. The platen holder is rotatably supported by a roller holder shaft (not shown).

A wedge is provided vertically inside of the rear cover 3 (not shown in FIG. 5). When the rear cover 3 is installed on the rear part of the body 2, this wedge is inserted into a guide hole 34, and it is placed between the platen holder and a positioning portion 35. The platen holder is turned in a direction so that the platen approaches the thermal head chip 32 by the above-described installation of the rear cover 3. After the rotation of the platen holder, the platen roller 23 presses a part of the tape of the tape cassette 26 against the thermal head 50. Tape drawn from the tape cassette 26 is selectively colored (i.e., it has images formed on it) due to heating by the thermal head 50 during a printing operation.

The thermal head mounting plate 33 and the body 2 may be molded into one unit. Both of them may be made of plastic.

When the tape cassette 26 is installed in the tape cassette holder 27, the thermal head mounting plate 33 is inserted into the guide hole 36 of the tape cassette 26.

A FFC 37 is connected to the thermal head chip 32 at one end. The FFC 37 passes through the cable hole 38 formed in the tape cassette holder 27, and is connected to the control circuit board 21 at the other end.

A guide member 39 and the body 2 may be molded into one unit. Both of them may be made of plastic. The guide member 39 is located close to the tape exit slot 8 which opens at a sidewall near a top of the tape cassette holder 27. This guide member 39 is taller than the thermal head mounting plate 33, and is inserted into a guide hole 40 of the tape cassette 26. When a user installs the tape cassette 26 into the tape cassette holder 27, the guide member 39 is inserted into the guide hole 40 before the thermal head mounting plate 33 is inserted into the guide hole 36 of the tape cassette 26, because it is taller than the thermal head mounting plate 33. At this point, guide member 39 works as an initial positioning guide of the tape cassette 26 in the tape cassette holder 27.

Figure 8B:
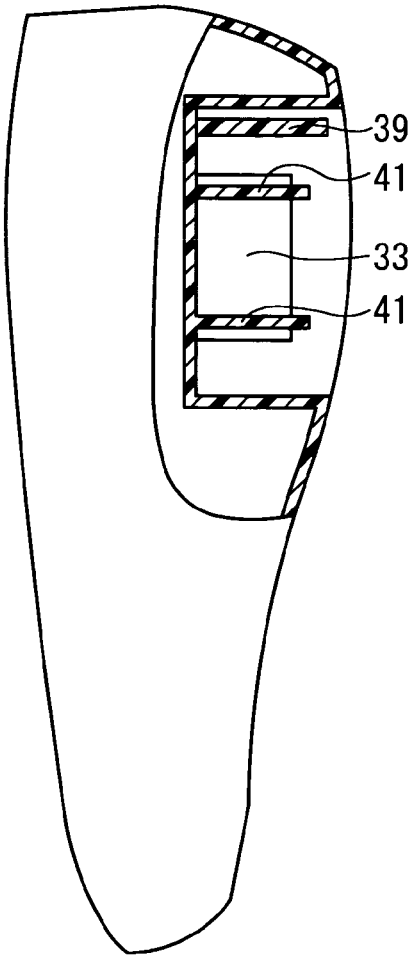
FIG. 8B is a side, partial cross-sectional view of the FIG. 8A tape printer, with the partial cross-section taken through the line B—B in FIG. 8A.
Figure 8A:
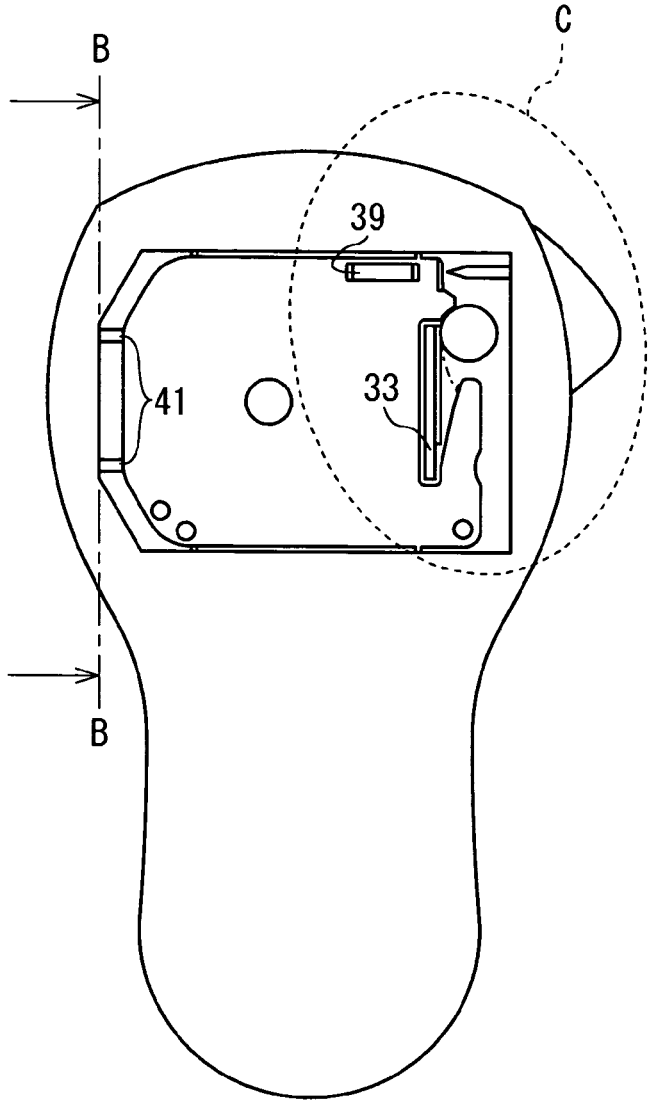
FIG. 8A is a plan view of a tape printer according to an embodiment of the invention.

Ribs 41 are formed vertically on the wall of the tape cassette holder 27 which faces the thermal head mounting plate 33 (leftside wall of the tape cassette holder 27 in FIGS. 5 and 8A). For example, there are two ribs 41 shown in FIGS. 5 and 8A. When the tape cassette 26 is installed in the tape cassette holder 27, these ribs 41 touch a side of the tape cassette 26 (left sidewall of the tape cassette 26 in FIGS. 5 and 8A). The ribs 41 help to lead the tape cassette 26 to its correct position with proper alignment maintained. The length of the ribs 41 is such that the tape cassette 26 comes into contact with ribs 41 before coming into contact with the thermal head mounting plate 33 and after coming into contact with the guide member 39. By this composition, when a tape cassette 26 is installed in the tape cassette holder 27, the guide member 39 is inserted into the guide hole 40 first. After that, the sidewall of the tape cassette 26 begins to touch ribs 41 during insertion of the cassette 26. Finally, the thermal head mounting plate 33 is inserted into the guide hole 36. FIG. 8B is a side view by which the relative heights of the guide members can be seen. In particular, the guide member 39 has a greatest height, the ribs 41 have the next greatest height, and the mounting plate 33 has the lowest height of the three.

Next, the construction of the tape cassette 26 will be described with reference to the FIG. 5. The tape is stored in the tape cassette 26 under a condition that it is wound around a tape spool. Adhesive is applied to the opposite side of the tape relative to the character printing side, and a strippable paper carrier is affixed to cover that adhesive. While characters or images are printing, the tape is urged forward by the rotation of platen roller 23. The tape passes through an arm-shaped guide member 42 formed in tape cassette 26 and exits from a tape exit slot (not shown in FIG. 5) formed by the guide member 42. The printed tape is sent out of the tape printing apparatus 1 from the tape exit 8.

The head mounting plate 33 passes through the guide hole 36 when tape cassette 26 is installed into the tape cassette holder 27. The guide hole 36 is partially surrounded by arm-shaped guide member 42, naked tape and a wall of the tape cassette 26 which faces the guide member 42 and a wall opposite on the side of the arm-shaped guide member 42. There is also the guide hole 40 in the tape cassette 26. The guide member 39 passes through the guide hole 40 when the tape cassette 26 is installed into the tape cassette holder 27.

Figure 6:
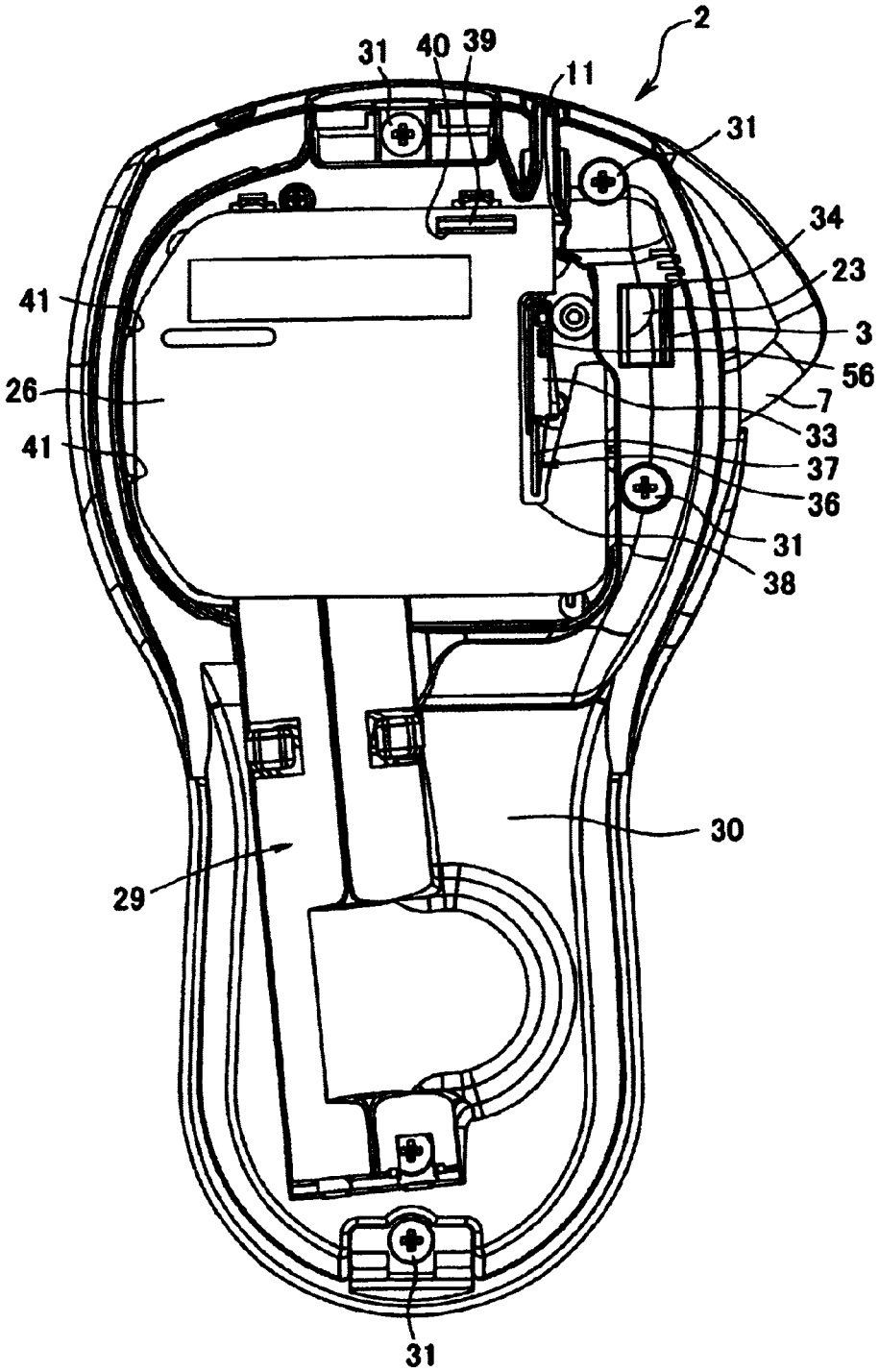
FIG. 6 is a plan view showing the tape printing apparatus and the tape cassette that is installed in the correct position.

Next, the action to install the tape cassette 26 into the tape cassette holder 27 will be described with reference to FIG. 5, FIG. 6 and FIGS. 10A–10D. FIGS. 10A–10D show different positions of the tape cassette 26 relative to the cassette holder 27 as the cassette is installed, and FIG. 6 shows the tape cassette 26 installed into the tape cassette holder 27.

The process of installing the tape cassette 26 into the tape cassette holder 27 includes three steps described below (1), (2) and (3): (1) Hold the tape cassette 26 almost horizontally; (2) Move the tape cassette 26 near to the tape cassette holder 27; and (3) Insert the guide member 39, which is formed highest, into the guide hole 40 of the tape cassette 26 (FIG. 10A).

Figure 10A:
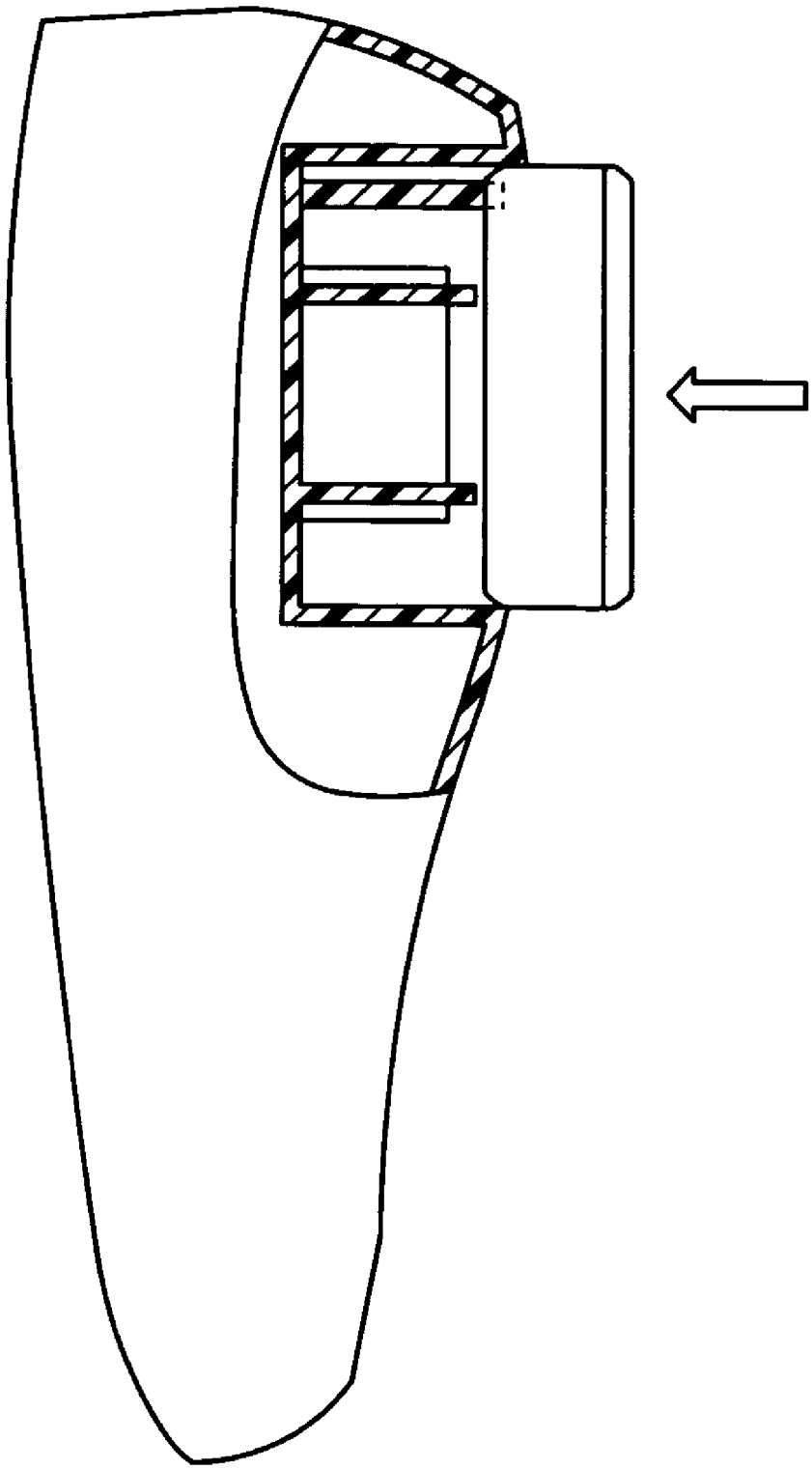
FIGS. 10A–10D are side, partial cross-sectional views showing a process of inserting a tape cassette into a tape printer according to one embodiment of the invention.
Figure 10B:
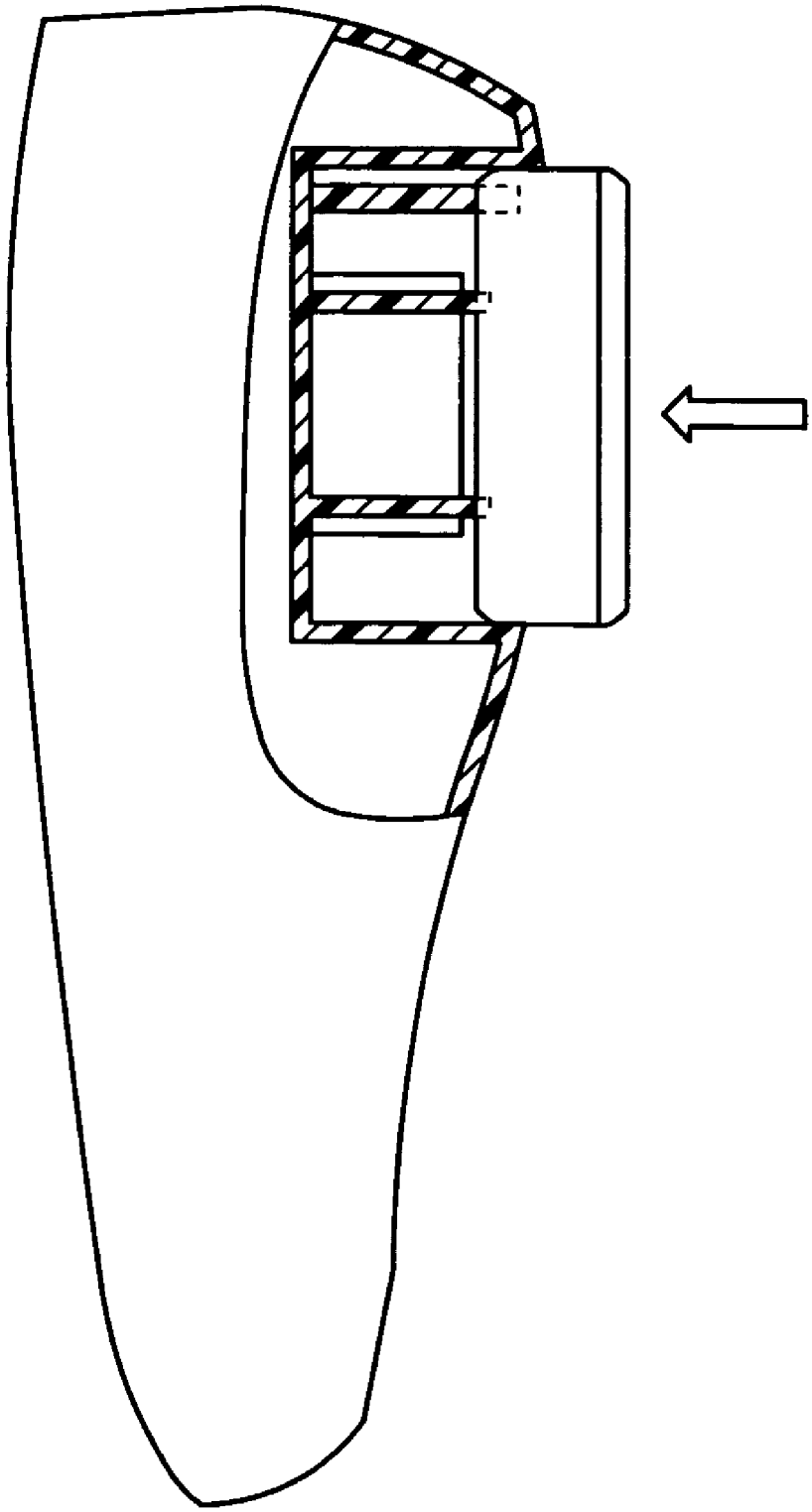
Figure 10C:
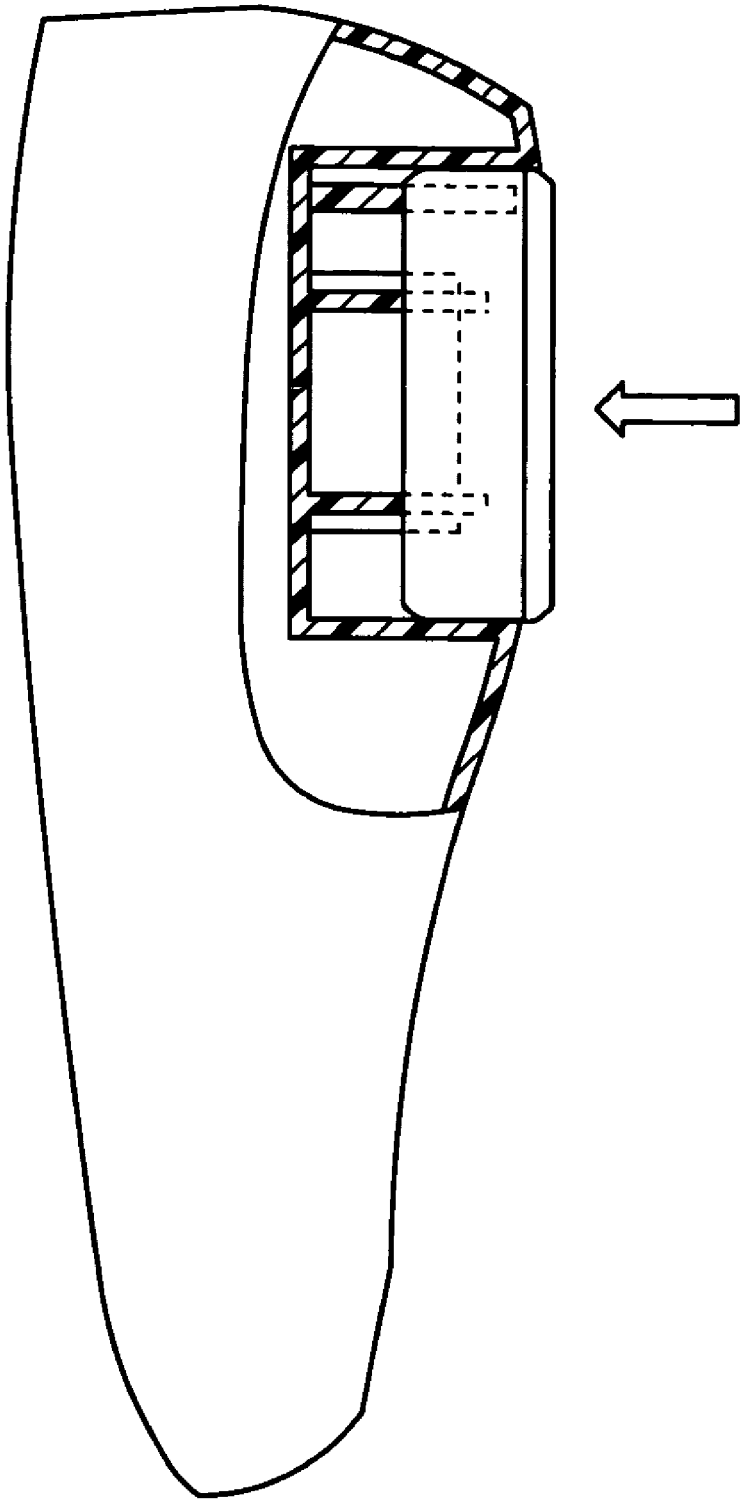
Figure 10D:
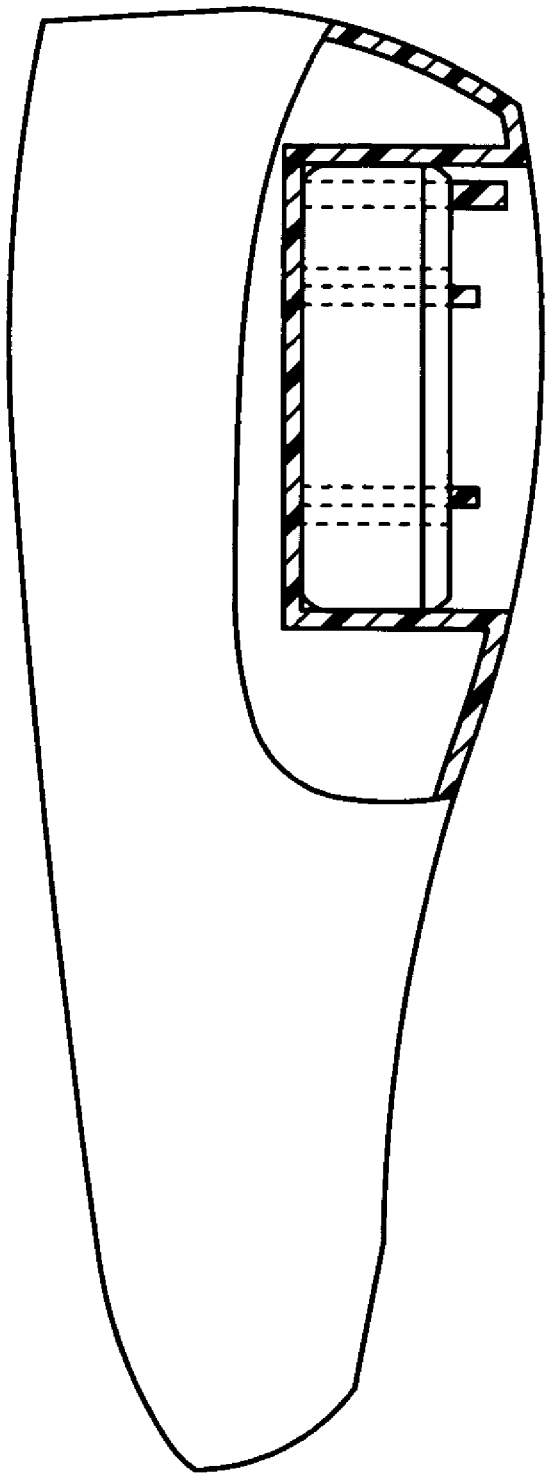

Fundamental positioning of the tape cassette 26, which faces the tape cassette holder 27, is done at the moment when the guide member 39 is partially inserted into the guide hole 40 (FIG. 10A). When tape cassette 26 is moved farther downward under this condition, the tape cassette 26 begin to touch the ribs 41 at the sidewall (FIG. 10B) (in FIG. 5, they are in the middle of the leftside wall). As the cassette 26 is further inserted, the mounting plate 33 enters the guide hole 36 (FIG. 10C). Then the cassette 26 is completely installed into the holder 27 by further insertion of the cassette 26 (FIG. 10D). The position and posture of the tape cassette 26 in the tape cassette holder 27 is lead to its correct position with proper posture maintained by the insertion of the guide member 39 and contact of the ribs 41.

The positional relations between the tape cassette 26 and the tape cassette holder 27 are decided first by the guide member 39 which is the tallest member in the tape cassette holder 27, and second by the ribs 41 which are the second tallest in the tape cassette holder 27. Because the position and the posture of the tape cassette relative to the tape cassette holder 27 are fixed by the guide members which are taller than the thermal head mounting plate 33, positional relations between the thermal head mounting plate 33 and the guide hole 36 can be prevented from deviating.

Therefore, even if the thermal head chip 32 on the thermal head mounting plate 33 and the control circuit board 21 are connected by a FFC 37, these height relations of guide members can reduce the likelihood of, or preferably prevent, the tape which is drawn out from the tape cassette 26 from being caught in the FFC 37. The height relations between members in the tape cassette holder 27 enable any user to install the tape cassette 26 into the tape cassette holder 27 easily while reducing or preventing tape jam.

Figure 8C:
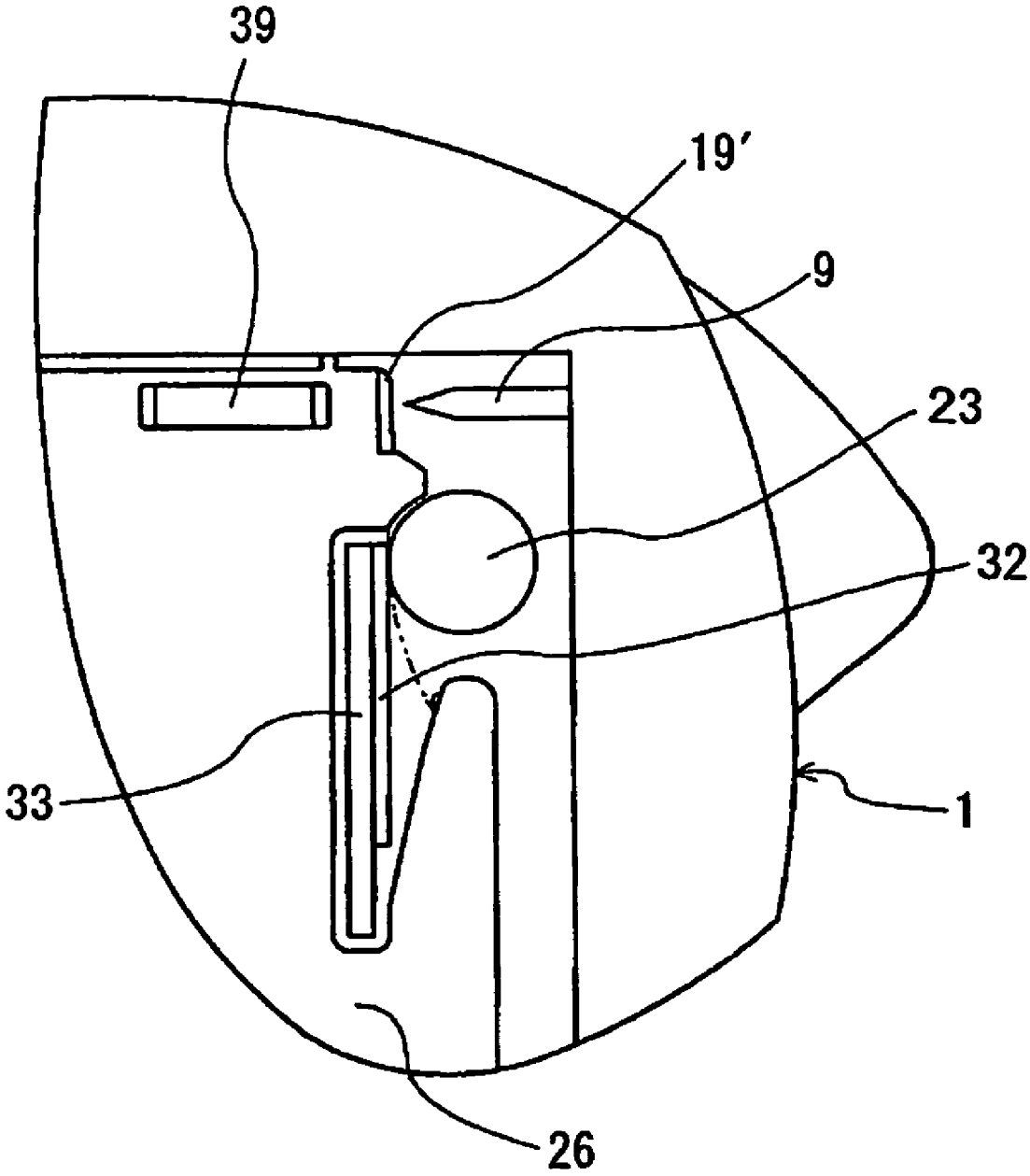
FIG. 8C is an enlarged view of the encircled area C in FIG. 8A, and shows an anvil formed on the tape cassette according to one embodiment of the invention.
Figure 9:
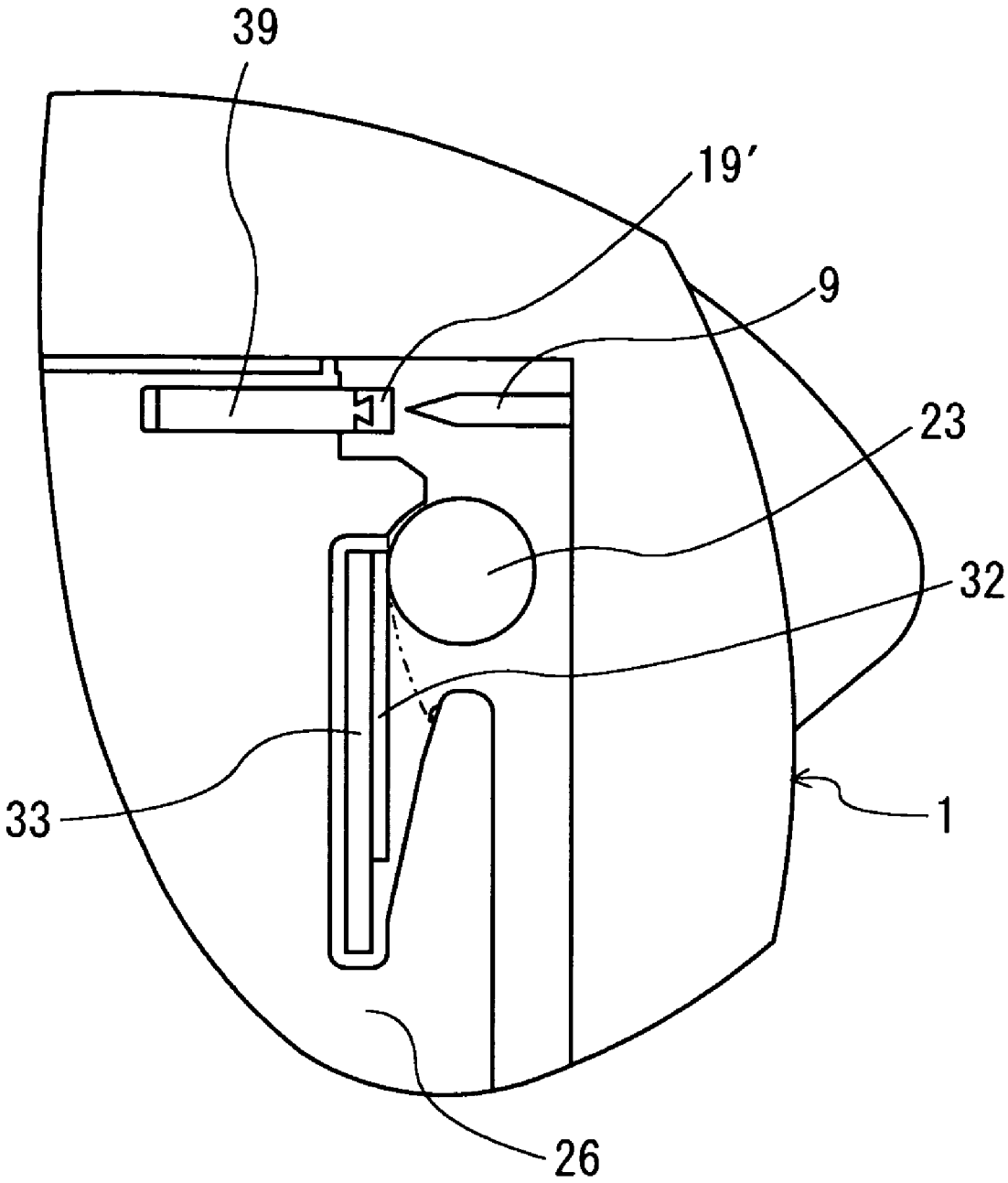
FIG. 9 is a view similar to FIG. 8C, but shows another embodiment of the invention in which the anvil is provided on the second guide member.

As shown in FIG. 8C, the tape cassette 26 can be provided with an anvil 19 (e.g., made of metal or plastic) that supports the tape when the tape is cut by the cutter 9. In this embodiment, the anvil is located on a part of the tape cassette 26 that is located close to the second guide hole 40. According to another embodiment, in which the second guide hole 40 extends through an outer surface of the tape cassette 26, the anvil 19' preferably is removably attached to the guide member 39 (e.g., by a screw connection or by a sliding connection) so that the anvil 19' can be replaced when it becomes worn. Thus, the anvil can be made a part of the tape cassette 26 (FIG. 8C) or a part of the guide member 39 (FIG. 9).

Figure 7A:
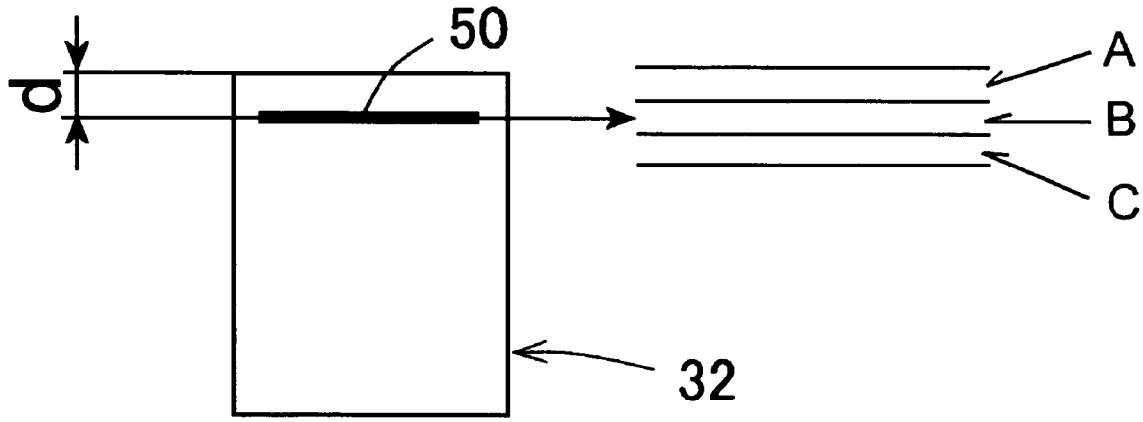

Next, one way of gluing the thermal head chip 32 onto the thermal head mounting plate 33 will be described with reference, to FIG. 7. The thermal head chip 32 is substantially rectangle-shaped (refer to FIG. 7A). The thermal head 50 is formed on the thermal head chip 32 (refer to FIG. 7A). Many heating elements are provided in one or more lines on the thermal head chip, and form the thermal head 50.

The thermal head 50 ideally should be formed at the edge of the thermal head chip 32. However, the edge of thermal head chip 32 is not smooth enough and the roughness of the edge of the thermal head chip 32 causes positioning errors of the thermal head 50 while forming the thermal head 50 on the thermal bead chip 32. In addition, a distance "d" from the edge (the top end in FIG. 7A) of the thermal head chip 32 to the thermal head 50 is not uniform. Accordingly, thermal heads are classified into ranks based on the area of the dispersion range of distance "d" (refer to FIG. 7A). An inspector confirms which of the range A, B or C, a thermal head 50 belongs to with a microscope. In particular, the inspector confirms within which position (the ranges A, B or C) a particular thermal head 50 is located. The range A, the range B and the range C are as shown in the right of FIG. 7A. The rank, which each thermal head chip 32 belongs to, is decided by this inspection.

Figure 7B:
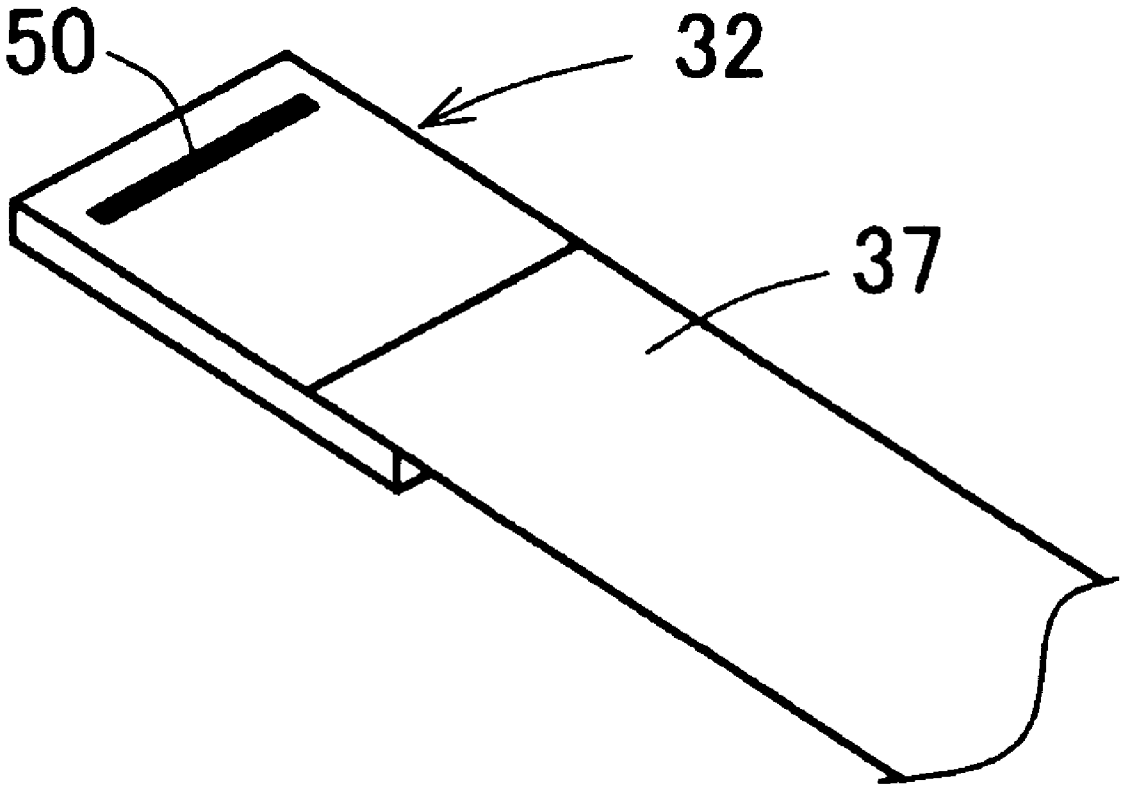
Figure 7C:
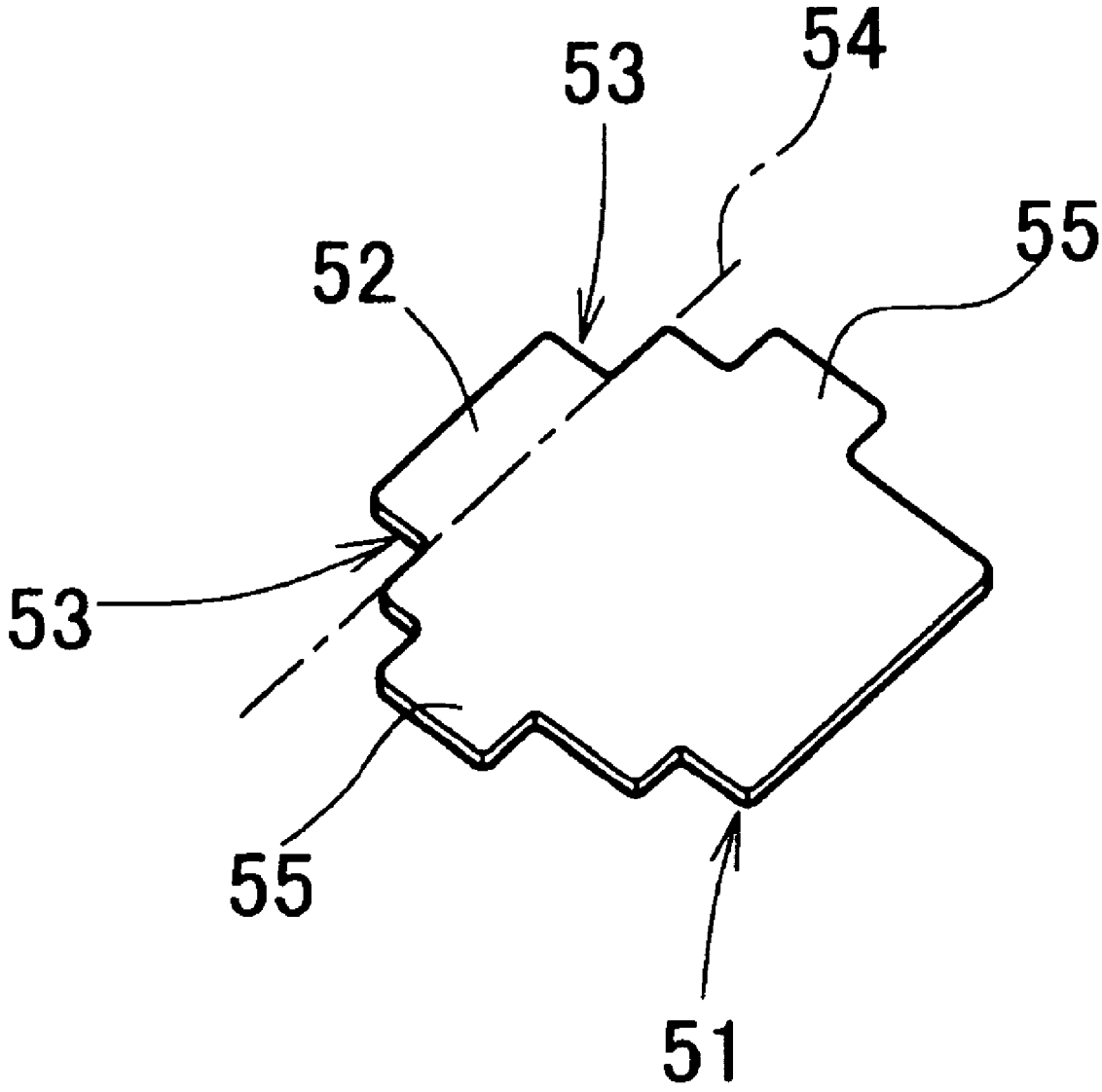

After the inspection, the terminals of the thermal head chip 32 and the FFC 37 are soldered as shown in FIG. 7B. The thermal head chip 32 soldered to the FFC 37 may be glued (or otherwise fixed) on a plate 51 as shown in FIG. 7C. The plate 51 is a substantially rectangle-shaped thin plate made, for example, of stainless steel or other metal. There is a step 53 on both sides of the projection 52 on the side of the plate 51.

The edge 54, which forms a step 53, becomes a reference line to arrange the line of the heating elements of the thermal head 50 on the thermal head chip 32.

There is a positioning piece 55 on both sides in the center of the plate 51. The positioning piece 55 is inserted into the guide hole 56 formed at the top end and the bottom end of the thermal head mounting plate 33, and it positions plate 51 and thermal head chip on the thermal head mounting plate 33.

Three kinds of jigs corresponding to rank of the head (rank A, B, or C) are used to glue (or otherwise fix) the thermal head chip 32 on the plate 51. For example, Jig A is made in consideration of the deviation range of the distance d in rank A. Jig A aligns the edge 54 that forms a step 53 in the plate 51 in line with the line of the heating elements of the thermal head 50 in the thermal head chip 32.

Similar to Jig A, Jig B is made in consideration of the deviation range of the distance d in rank B. Jig B aligns the edge 54 that forms a step 53 in the plate 51 in line with the line of the heating elements of the thermal head 50 in the thermal head chip 32.

Similar to Jig A, Jig C is made in consideration of the deviation range of the distance d in rank C. Jig C aligns the edge 54 that forms a step 53 in the plate 51 in line with the line of the heating elements of the thermal head 50 in the thermal head chip 32.

By fixing the thermal head chip 32 to the plate 51 by using the jig fit to the rank of the thermal head chip 32, the orientation of the heating elements of the thermal head 50 on the thermal head chip 32 of any rank can be lined up with the edge 54.

The positioning piece 55 is inserted into the guide hole 56 of the thermal head mounting plate 33, and the plate 51 which thermal head chip 32 is fixed in the correct position. By this insertion, the orientation of the heating elements of the thermal head 50 is arranged at the correct position. Therefore, the thermal head 50 is fixed to the plate 51 so that the orientation of the heating elements of the thermal head 50 is lined up with the edge 54. When the positioning piece 55 of the plate 51 is inserted into the positioning hole of the thermal head holding member 33 after the thermal head chip 32 has been fixed to the plate 51 as mentioned above, the orientation of the line of the heating elements of the thermal head 50 can be fixed to the correct position and direction for printing. Thus, adjustment of the position of the thermal head holding member 33 is not required after the plate 50 with the thermal head chip 32 is fixed on the thermal head holding member 33.

This method of fixing enables the tape cassette holder 27 and the thermal head holding member 33 to be molded into one unit in various exemplary embodiments. Further, thermal head 50 on the thermal head chip 32 easily can be arranged to its correct position without complicated positioning adjustment work of the thermal head chip 32 to the thermal heading mounting plate 33. Therefore, the tape printing apparatus 1 can be made smaller and more economical. Even if the position of the thermal head 50 in the thermal head chip 32 is not uniform, the relative position of the thermal head 50 to the plate 51 always can be secured in the best relation by this composition.

While the invention has been described with reference to exemplary embodiments, it is to be understood that the invention is not limited to the exemplary embodiments or constructions. While the various elements of the exemplary embodiments are shown in various combinations and configurations, which are exemplary, other combination and configurations, including more, less or only a single element, are also within the spirit and scope of the invention.

What is claimed is:

1. A tape printing apparatus that uses a tape cassette having two guide holes, the tape printing apparatus having a tape cassette holder comprising:

at least first and second guide members;

the first guide member having a height that is shorter than a height of the second guide member;

the second guide member being inserted into a second guide hole of the tape cassette and the first guide member being inserted into a first guide hole of the tape cassette; and a tape cutting apparatus that includes a movable cutter blade to cut tape, wherein an anvil for the movable cutter blade is provided on the second guide member.

2. The tape printing apparatus according to claim 1, wherein the first guide member and the second guide member are molded out of plastic into one unit with the tape cassette holder.

3. The tape printing apparatus according to claim 1, wherein the tape cassette holder further comprises:

a third guide member, wherein the third guide member has a height that is taller than the first guide member and that is shorter than the height of the second guide member;

the third guide member is opposed to the first guide member; and the third guide member holds a side of the tape cassette to lead the tape cassette to its correct position to maintain alignment of the tape cassette and the first guide member.

4. The tape printing apparatus according to claim 3, wherein the third guide member comprises multiple ribs.

5. The tape printing apparatus according to claim 4, wherein the ribs are provided vertically on a side wall of the tape cassette holder, and extend from a bottom of the tape cassette holder.

6. The tape printing apparatus according to claim 4, wherein top ends of the ribs are fonned at an angle relative to a sidewall of the tape cassette holder.

7. The tape printing apparatus according to claim 3, wherein the second guide member is initially inserted into the second guide hole of the tape cassette and the tape cassette is held loosely in a correct position, then the third guide member contacts a side of the tape cassette to fix the tape cassette in the correct position tightly, and next the first guide member is inserted into the first guide hole of the tape cassette.

8. The tape printing apparatus according to claim 3, wherein the first guide member, the second guide member, and the third guide member are molded out of plastic into one unit with the tape cassette holder.

9. The tape printing apparatus according to claim 1, wherein the first guide member includes a thermal printhead mounted to the first guide member.

10. A tape printing apparatus that uses a tape cassette having two guide holes, the tape printing apparatus having a tape cassette holder comprising:

first, second and third guide members;

the first guide member having a height that is shorter than a height of the second and third guide members, a thermal printhead disposed on the first guide member; and the second guide member having a height that is higher than the height of the first and third guide members; and the third guide member is located on a wall of the tape cassette holder opposite the first guide member; such that the second guide member is initially inserted in a second guide hole of the tape cassette and the tape cassette is held loosely in a correct position, the third guide member contacts a side of the tape cassette next to fix the tape cassette in the correct position tightly, and next the first guide member is inserted into the first guide hole of the tape cassette.

11. The tape printing apparatus according to claim 10, further comprising:

a tape cuffing apparatus that includes a movable cutter blade to cut tape, wherein an anvil for the movable cutter blade is located close to the second guide member.

12. The tape printing apparatus according to claim 11, wherein the anvil is provided on the second guide member.

13. The tape printing apparatus according to claim 11, wherein the anvil is located on the tape cassette.

14. The tape printing apparatus according to claim 10, wherein the third guide member comprises multiple ribs.

15. The tape printing apparatus according to claim 14, wherein the multiple ribs are provided vertically in relation to a bottom wall of the tape cassette holder.

16. The tape printing apparatus according to claim 14, wherein the multiple ribs are provided at an angle with respect to a sidewall of the tape cassette holder.

17. The tape printing apparatus according to claim 10, wherein the first guide member, the second guide member and the third guide member are molded out of plastic into one unit with the tape cassette holder.

18. A tape printing apparatus that uses a tape cassette having two guide holes, the tape printing apparatus having a tape cassette holder comprising:

at least first and second guide members, a thermal printhead disposed on the first guide member;

the second guide member having a top end that is located at a higher position than a top end of the first guide member;

such that the second guide member is inserted into a second guide hole of the tape cassette before the first guide member is inserted into a first guide hole of the tape cassette.

19. A tape printing apparatus that uses a tape cassette having two guide holes, the tape printing apparatus having a tape cassette holder comprising:

at least first and second guide members, the first guide member having a height that is shorter than a height of the second guide member, the second guide member being inserted into a second guide hole of the tape cassette and the first guide member being inserted into a first guide hole of the tape cassette; and a tape cutting apparatus that includes a moveable cutter blade to cut tape, wherein an anvil for the movable cutter blade is located on the tape cassette.

20. The tape printing apparatus according to claim 19, wherein the first guide member and the second guide member are molded out of plastic into one unit with the tape cassette holder.

21. The tape printing apparatus according to claim 19, wherein the tape cassette holder further comprises:

a third guide member, wherein the third guide member has a height that is taller than the first guide member and that is shorter than the height of the second guide member;

the third guide member is opposed to the first guide member; and the third guide member holds a side of the tape cassette to lead the tape cassette to its correct position to maintain alignment of the tape cassette and the first guide member.

22. The tape printing apparatus according to claim 21, wherein the third guide member comprises multiple ribs.

23. The tape printing apparatus according to claim 22, wherein the ribs are provided vertically on a side wall of the tape cassette holder, and extend from a bottom of the tape cassette holder.

24. The tape printing apparatus according to claim 22, wherein top ends of the ribs are formed at an angle relative to a sidewall of the tape cassette holder.

25. The tape printing apparatus according to claim 21, wherein the second guide member is initially inserted into the second guide hole of the tape cassette and the tape cassette is held loosely in a correct position, then the third guide member contacts a side of the tape cassette to fix the tape cassette in the correct position tightly, and next the first guide member is inserted into the first guide hole of the tape cassette.

26. The tape printing apparatus according to claim 21, wherein the first guide member, the second guide member, and the third guide member are molded out of plastic into one unit with the tape cassette holder.

27. The tape printing apparatus according to claim 19, wherein the first guide member includes a thermal printhead mounted to the first guide member.

28. A tape printing apparatus that uses a tape cassette having two guide holes, the tape printing apparatus having a tape cassette holder comprising:

at least first and second guide members, the first guide member having a height that is shorter than a height of the second guide member, a thermal printhead disposed on the first guide member, the second guide member being inserted into a second guide hole of the tape cassette and the first guide member being inserted into a first guide hole of the tape cassette.

29. The tape printing apparatus according to claim 28, wherein the first guide member and the second guide member are molded out of plastic into one unit with the tape cassette holder.

30. The tape printing apparatus according to claim 28, further comprising:

a tape cutting apparatus that includes a movable cutter blade to cut tape, wherein an anvil for the movable cutter blade is located close to the second guide member.

31. The tape printing apparatus according to claim 30, wherein the anvil is provided on the second guide member.

32. The tape printing apparatus according to claim 30, wherein the anvil is located on the tape cassette.

33. The tape printing apparatus according to claim 28, wherein the tape cassette holder further comprises:

a third guide member, wherein the third guide member has a height that is taller than the first guide member and that is shorter than the height of the second guide member;

the third guide member is opposed to the first guide member; and the third guide member holds a side of the tape cassette to lead the tape cassette to its correct position to maintain alignment of the tape cassette and the first guide member.

34. The tape printing apparatus according to claim 33, further comprising:

a tape cutting apparatus that includes a movable cutter blade to cut tape, wherein an anvil for the movable cutter blade is located close to the second guide member.

35. The tape printing apparatus according to claim 34, wherein the anvil is provided on the second guide member.

36. The tape printing apparatus according to claim 34, wherein the anvil is located on the tape cassette.

37. The tape printing apparatus according to claim 33, wherein the third guide member comprises multiple ribs.

38. The tape printing apparatus according to claim 37, wherein the ribs are provided vertically on a side wall of the tape cassette holder, and extend from a bottom of the tape cassette holder.

39. The tape printing apparatus according to claim 37, wherein top ends of the ribs are formed at an angle relative to a sidewall of the tape cassette holder.

40. The tape printing apparatus according to claim 33, wherein the second guide member is initially inserted into the second guide hole of the tape cassette and the tape cassette is held loosely in a correct position, then the third guide member contacts a side of the tape cassette to fix the tape cassette in the correct position tightly, and next the first guide member is inserted into the first guide hole of the tape cassette.

41. The tape printing apparatus according to claim 33, wherein the first guide member, the second guide member, and the third guide member are molded out of plastic into one unit with the tape cassette holder.

* * * * *